US005589812A

United States Patent [19]

Jones

[11] Patent Number: 5,589,812

[45] Date of Patent: Dec. 31, 1996

[54] PERSONAL METER TIMING DEVICE

[76] Inventor: Rickey A. Jones, 1248 W. 127th St., Los Angeles, Calif. 90044

[21] Appl. No.: 369,714

[22] Filed: Jan. 6, 1995

[51] Int. Cl.[6] ..... G08B 1/00; G07F 7/00

[52] U.S. Cl. ..... 340/309.15; 340/932.2; 368/7; 368/90; 368/92; 194/205; 194/217

[58] Field of Search ..... 340/309.15, 932.2; 368/7, 8, 89, 90, 92; 364/467; 235/377; 194/205, 217

[56] References Cited

U.S. PATENT DOCUMENTS

| | | | |
|---|---|---|---|
| 4,356,903 | 11/1982 | Lemelson et al. | 340/539 |
| 4,847,776 | 7/1989 | Huang | 340/932.2 |
| 5,166,680 | 11/1992 | Ganot | 340/932.2 |
| 5,266,947 | 11/1993 | Fujiwara et al. | 340/309.15 |
| 5,309,414 | 5/1994 | Chiu | 369/90 |
| 5,382,780 | 1/1995 | Carmen | 235/384 |
| 5,443,193 | 8/1995 | Lenard | 224/252 |

*Primary Examiner*—Donnie L. Crosland
*Attorney, Agent, or Firm*—Gene Scott; Patent Law & Venture Group

[57] ABSTRACT

A portable timing device designed for use in conjunction with metered machinery, the device contained within a compact case with a clip on the back side, allowing the device to be fastened to an article of clothing or the like. The case further includes a means to store and dispense a plurality of coins for use in the meter, and an external actuation means by which the appropriate time interval is programmed. An electrical circuit is enclosed within the case, the circuit powered by a rechargeable battery which is connected to a solar energy collection device for recharging it. The circuit programs and times the selected time interval, and emits an audible warning signal when ten minutes, five minutes and no time remains in the time interval.

5 Claims, 2 Drawing Sheets

PERSONAL METER TIMING DEVICE

FIELD OF THE INVENTION

This invention relates generally to timing devices and more particularly to a portable timing device and money holder combination particularly for use in conjunction with parking meters and other such coin operated machinery requiring cognesence of a countdown timing sequence.

BACKGROUND OF THE INVENTION

Although using coin-operated machinery can be a relatively simple procedure, there are two main factors that frequently inhibit successful operation. First of all, most metered machinery requires exact change in order to begin the meter, and, unfortunately, many meters only except certain types of coins, such quarters or dimes. Thus, users who are without the exact required change are either unable to use the machinery at all, or must limit use to correspond with what usable change they have available. Secondly, with many types of coin-operated machinery, once the proper change has been fed into the machine the user leaves the immediate area, intending to return before the expiration of the time interval. Unfortunately, properly monitoring the time interval is often rather difficult, causing many users to fail to return to the machine before the time duration has expired.

These inhibiting factors can be particularly detrimental in association with vehicle parking meters. For instance, lacking the proper change necessary to operate a parking meter not only prevents successful operation of the meter, but it may also keep the user from being able to park a vehicle at all. Even worse, letting the meter expire without adding more change to it or moving the parked vehicle can result in otherwise avoidable parking fines. Likewise, in laundromats where the machines are often in nearly constant demand, such as those included in many apartment complexes, it is imperative to have proper change on hand, as failure to have correct change can translate into long waits for another available machine. It is also important to keep track of the time remaining on a machine's cycle to ensure that there will be a dryer available to put the laundry into, and to prevent the laundry from being moved by others.

Although invention and use of both change holders and timing devices are known to the public, the frequency in which these obstacles are incurred illustrate that such prior art devices are widely ineffective in ensuring successful operation of metered machinery. Timers come in a large variety of configurations, from stationary timers included in appliances such as stoves and microwaves to small egg timers and hour glasses. Since most of these devices are not specifically portable, watches are typically used to monitor the time interval of a coin-operated device, as they are portable and convenient. However, many standard watches do not include an elapsed time period timing device, or setting the timing device is too time consuming or difficult, so people often merely glance at the watch when the machine is started, making a mental note as to the time of completion. Unfortunately, as people go about their business during the timed interval, they tend to either forget the completion time or forget to frequently check the present time, thereby missing the expiration time. In addition, many people do not regularly wear a watch.

Likewise, money holders range from wallets and billfolds to money clips and coin purses. However, most common money holders do not have separate compartments to sort change, and very few provide space in which to separate a particular type of coin from the rest of the loose change. These limitations prevent users from having an accurate count of their change, which in turn leads to insufficient funds when money is needed for parking meters, washing machines and the like.

Thus, present timing devices and money holders are often inadequate aid in successfully operating and monitoring coin-operated machines. In addition, individually, neither device ensures complete operating success, as having a timing device available does not ensure that the user will have the change needed to operate the device, and having the necessary change does not mean that the user will have a timer available, or effectively use it to monitor the machine's time interval.

Obviously then there is a need for a single, portable device that can at once hold change to operate machinery as well as monitor the machine's time interval. The present invention synergistically fulfills these needs and provides further related advantages as described in the following summary.

SUMMARY OF THE INVENTION

The instant invention is an inventive combination of several known prior art devices. It combines the features of a standard timing device with alarm, the benefits of a money holder in a design similar to that of a paging device in order to provide a convenient device especially for use in conjunction with and to ease in the operation of coin-operated machinery, such as parking meters and washing machines. This new combination of features has unique synergistic benefits that cannot be attained separately by any of the individual prior art devices. As such, it is an object of the present invention to provide a device that combines all of the advantages of the various prior art devices into a single, easy to carry device.

The present invention has a means for holding coins. Thus, if the proper change cannot be found, or if the coin-operated machine takes more change than expected, the present invention can provide the necessary change. It is therefore an object of the invention to ensure that the proper change can be located to operate the machine.

The invention also includes a timing device that preferably has a maximum countdown time of 24 hours, and a 20 minute count-up cycle. The hours and minutes are set by individual buttons, and the device is reset when both the hour and minute buttons are pushed simultaneously. This prevents the timer from being accidentally reset. Thus, once the proper change has been fed into the machine, the timer is easily programmed to count down the time interval of the machine. The instant invention also includes an audible alarm that indicates to the user that the time interval of the coin-operated machine has nearly elapsed. The invention signals at both the ten and five minute mark, and the final alarm sounds for a full minute before the timing interval is complete. The alarm can be disabled by pressing both the hour and minute button simultaneously. Thus it is an object of the invention to easily and conveniently monitor the time remaining in a coin-operated machine and to alert the user as the end of the interval draws near, thereby allowing the user plenty of time to return to the machine before the time expires.

The device operates preferably by a single, replaceable 1.5 volt battery. It also includes an on/off switch so that the device can be paused when not in use, thereby greatly increasing the life of the battery. Preferably, the battery is rechargeable, and may be interconnected with a solar collector that continually recharges it.

The invention has a small, compact box shape, with a clip on the back side of it to allow the device to be easily attached to an article of clothing, such as a belt, thus ensuring that the audible warning alarms will be heard by the user. The design of the invention is similar to a typical, portable paging device. However, unlike standard pagers, the digital time display, the reset buttons and the coin aperture are all located on the back side of the device, so that when it is clipped to clothing everything faces toward the body, keeping the reset buttons from being accidentally contacted and the stored coin supply from being visible. It is therefore an object of the invention to provide a design that is compact, easily portable, and secure.

It is yet another object of the invention to provide a design that makes the device convenient for a wide variety of uses in addition to those associated with coin-operated machinery. The device is a great improvement over stationary timers included in ovens and microwaves, or other typical kitchen timers, as it allows the user to move freely about the house and yard while timing cooking food, ensuring that the timer will be instantly heard and the food tended to before it burns, no matter what the location of the user. The invention is also suitable for use in exercise activities, such as running, in which it is desirable to carry a small amount of money and a timing device, but where the appropriate exercise clothing often does not include pockets to conveniently do so.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the prefered mode of the present invention. In such drawings.

DETAILED DESCRIPTION OF THE PREFERRED EMBODIMENT

Figure 2:
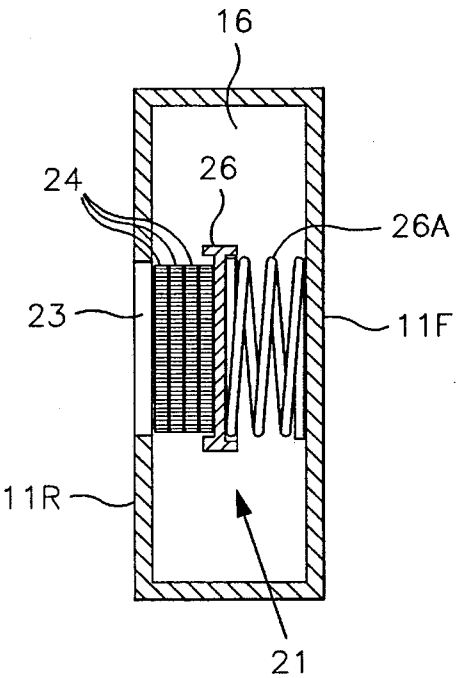
FIG. 2 is a cross-sectional view taken along line 2—2 of FIG. 1 and , particularly showing the prefered structure of the coin storage means.
Figure 1:
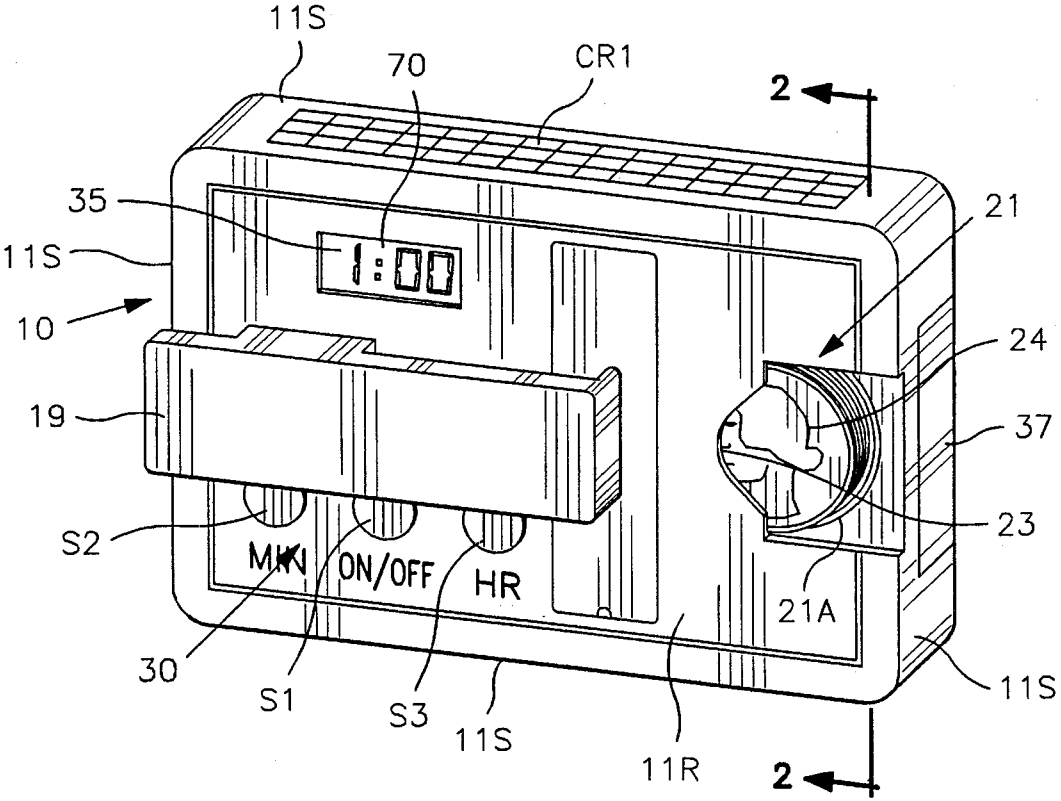
FIG. 1 is a perspective view of the the present invention, particularly showing a coin aperture, actuation means, display window and clip located on the rear wall of the device's case.
Figure 3:
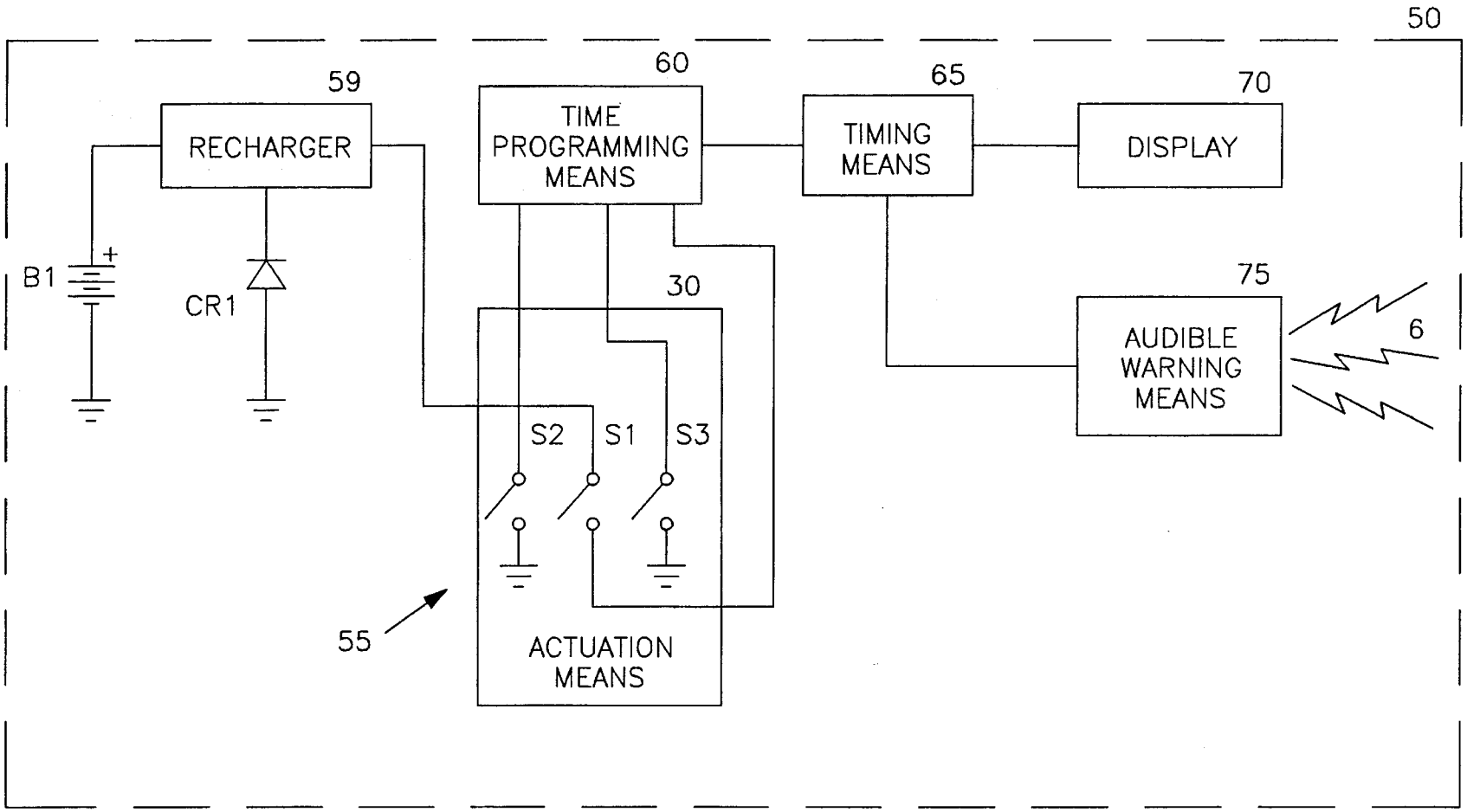
FIG. 3 is an electrical block diagram of the invention of FIG. 1, particularly showing the interrelationship of the various components of an electrical circuit of the invention.

FIGS. 1–3 show a portable meter timing device that can be used to monitor the timing duration of a coin operated meter or machine. The timing device is easily programmed to coincide with the timing of the machine or meter, and automatically provides an audible warning signal 6 at predetermined intervals as the expiration time approaches. Thus, the timing device is particularly useful for use in conjunction with parking meters, as it alerts the user before the meter expires, thereby helping to insure the effective use of a municipal parking control system.

As illustrated in FIG. 1, the timing device is contained in a relatively small, compact case 10 that makes it ideal for carrying on one's person. The case 10 preferably has a rectangular, box-like shape with front and rear opposing walls, 11F and 11R. The opposing walls 11F and 11R are interconnected with a plurality of side walls 11S, providing rigidity and fully enclosing an interior space 16 within the case 10.

The rear wall 11R of the case 10 has a durable, pivotable, preferably spring biased clip 19 that easily attaches to a supporting element (not shown). This allows the timing device to be carried not only in a purse or pocket, but also, if desired, conveniently clipped onto a supporting element, such as a belt, an edge of a pocket or waist of a pair of pants. Utilizing the clipping feature of the device ensures that the device will be within hearing and reaching distance when the audible warning signals 6 sound.

Since the timing device is designed to be used in conjunction with coin-operated machinery, it also includes a coin storage means 21 that holds and stores coins, as shown in FIG. 2. The coin storage means 21 is positioned within the interior space 16 of the case 10, and is adjacent an aperture 23 in the case's rear wall 11R. A biasing means 26, preferably a spring, is included so that the user can dispense the coins from the coin storage means 21 through the aperture 23 in sequence. As seen in FIG. 1, once a coin is in the aperture 23, it is easily accessible to the user. FIG. 2 illustrates just one possible means for storing a plurality of coins, such as quarters for a parking meter or public washing machine. This figure shows elements of the coin holder in a simplified manner, the coins being pressed against a coin support 26 which is biased toward the apertue 23 by a bias means 26A such as a coil spring. Other elements may be desired for trouble free use of such a means for holding the coins, such as internal side walls but these are not shown in FIG. 2 for the sake of clarity. As can be seen in FIG. 1, a slot 21A is impressed into the rear surface 11R so that a coin 24 may be inserted into the aperture 23. By these means, i.e., the aperture 23, the slot 21A, the coin support 26 and the bias means 26A, it is possible to insert a plurality of coins 24 into the case 10, and then retreive these coins 24 at a later time.

The rear wall 11R of the case 10 also includes an external actuation means 30 by which to control the timing device. The actuation means 30 preferable consists of a series of switches, preferably in the form of push buttons. As seen in FIG. 1, a first switch S1 is used to turn the power of the timing device on and off. In the prefered mode, once the power is turned on, a second and third switch S2 and S3 are used to set an appropriate timing duration, preferably corresponding with the duration of a meter or machine cycle. The second switch S2 is used to set minutes and the third switch S3 to set the hours of the timing duration, the timing device being capable of monitoring a timing duration of up to 24 hours. By providing independent hour and minute switches S2 and S3 to set the desired timing duration, it may be set more precisely than other common timers, thus further tailoring it for use with metered machinery. In certain applications timing durations may need to be measured over longer periods so that a switch of days or even weeks could be alternately employed. In other applications, the timing duration may require more precise timing such as to within one second or even a part of a second, so that the present invention could be applied to a rather broad range of applications by simply selecting other timing duration ranges and precisions, all of which would fall within the scope of the present invention.

Once the desired timing duration has been programmed, the first switch S1 is actuated to begin the countdown. When ten minutes remain before the timing duration expires, the device emits an audible warning signal 6. The user can terminate the warning signal 6 by either pressing the first switch S1, or by actuating the second and third switches, S2 and S3, simultaneously. Another warning signal 6 is emitted when five minutes remain, and again when the timing duration expires. The final warning signal 6 sounds for a full minute unless deactivated. The timer is reset by pressing the second and third switches S2 and S3 in unison.

A window 35 is included on the rear wall 11R, so that the set or remaining time as displayed by the display means 70 can be easily observed.

Placing the coin aperture 23, the actuation means 30 and the display window 35 all on the rear wall 11R of the case 10 is a very important, novel and useful inventive feature of the device that provides added security and privacy. When the timer is secured to an article of the user's clothing with the clip 19, the case's blank front wall 11F faces outwardly and the rear wall 11R faces inwardly toward the user's body, thus preventing the contents of the coin aperture 23 from being viewed and the switches S1, S2 and S3 from being inadvertently actuated.

An electrical circuit 50 with a plurality of electrical components 55 is contained within the interior space 16 of the case 10 (FIG. 3). The power source B1 of the circuit 50 is preferably a rechargeable battery interconnected to a solar energy collection device CR1, and a recharger circuit 59, so that the power source B1 can be constantly recharged. This provides greater consistency and reliability to the device, as it prevents the power source B1 from failing for lack of energy before or during a timing procedure. As seen in FIG. 1, the solar energy collection device CR1 may be contained within one of the side walls 11S of the shell 14 so that it is readily exposed to bright light. Alternately, the collection device CR1 may be positioned on the outfacing front surface 11F. An access cover 37 comprises a portion of one of the walls 11S, the cover 37 being removably attached to the case 10 in order to gain access to the power source B1 as needed for replacement.

Other components 55 of the electrical circuit 50 include a timing duration programming means 60, preferably a digital logic network, a timing means 65, preferably a clock integrated circuit with controller, a time set/remaining display means 70, preferably a liquid crystal display integrated circuit, an audible warning means 75, preferably a crystal sound generator bell, transducer or piezo disk alarm, or other miniature sound gererating device, and a power switch S1. The components of the circuit 55 are interconnected to enable the selected timing duration to be programmed and timed, and to provide an audible warning signal 6 at the appropriate intervals and at the expiration of the timing duration.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A portable parking meter timing device comprising:

an electrical circuit having a plurality of electrical components including a power source, a timing duration programming means, a timing means, a time set and remaining display means, an audible warning means, and a power switch, the components interconnected to enable programming of a selected timing duration, timing said timing duration, and providing an audible warning signal when said timing duration is completed;

a case providing a from and a rear opposing walls and a plurality of side walls interconnecting the front and rear walls and providing rigidity to the case and fully enclosing an interior space within the walls for holding the electrical circuit, an aperture in the rear wall for accepting coins for storage therein, the rear wall further providing, mounted pivotally thereon, a clip capable of attaching the case to a support element, and a window enabling observation of the display means, and an actuation means enabling the setting of a timing duration into the timing duration programming means, the silencing of the audible alarm means, and the turning of the timing device off and on.

2. The device of claim 1 further including an access cover removably attached to the case and forming a portion of one of the walls thereof, the cover providing access to the power source for replacement thereof.

3. The device of claim 1 further including a coin storage means within the case space, adjacent the coin aperture, the storage means accepting a plurality of coins inserted thereinto, and further including a bias means providing for dispensing the coins in sequence to the coin aperture for manual removal.

4. The device of claim 1 wherein the power source is a solar energy collection device.

5. The device of claim 1 wherein the power source is a rechargeable battery and further including a solar energy collection device interconnected thereto for recharging the battery.

* * * * *